United States Patent [19]

Stoll

[11] Patent Number: 4,736,675

[45] Date of Patent: Apr. 12, 1988

[54] PISTON ROTATION PREVENTING GUIDE ROD IN CYLINDER TIE ROD OPENING

[76] Inventor: Kurt Stoll, Lenzhalde, 72, 7300 Esslingen, Fed. Rep. of Germany

[21] Appl. No.: 831,928

[22] Filed: Feb. 20, 1986

[30] Foreign Application Priority Data

Feb. 22, 1985 [DE] Fed. Rep. of Germany ... 8505017[U]

[51] Int. Cl.[4] ..... F01B 9/02

[52] U.S. Cl. ..... 92/13; 92/128; 92/165 PR; 92/165 R; 92/169

[58] Field of Search ..... 92/13.7, 13.8, 5 R, 92/165 PR, 128, 13, 169.1; 91/303

[56] References Cited

U.S. PATENT DOCUMENTS

| | | | |
|---|---|---|---|
| Re. 25,257 | 10/1962 | Ellis | 92/13 X |
| 1,592,918 | 7/1926 | Bragg et al. | 91/185 X |
| 1,922,874 | 8/1933 | Tymstra | 92/13.8 X |
| 2,547,861 | 4/1951 | Fletcher | 91/433 X |
| 2,568,450 | 9/1951 | Hjarpe | 91/279 |
| 2,736,296 | 2/1956 | Romine et al. | 91/277 X |
| 2,887,094 | 5/1959 | Krukemeier | 92/13.7 X |
| 2,964,020 | 12/1960 | Fibaugh | 92/13.8 |
| 3,042,121 | 7/1962 | Broetzman et al. | 92/13.7 X |
| 3,095,785 | 7/1963 | Cahill | 92/5 R X |
| 3,180,236 | 4/1965 | Beckett | 92/169 X |
| 3,559,539 | 2/1971 | Nagy | 92/169 X |
| 3,673,925 | 7/1972 | Davies | 92/128 |
| 3,835,753 | 9/1974 | Bunyard | 92/5 R X |
| 4,351,628 | 9/1982 | Irexel et al. | 92/165 PR X |
| 4,608,912 | 9/1986 | Navarette | 92/169 X |

FOREIGN PATENT DOCUMENTS

| | | | |
|---|---|---|---|
| 2255050 | 5/1974 | Fed. Rep. of Germany | 92/165 PR |
| 2637290 | 2/1978 | Fed. Rep. of Germany | 92/165 PR |
| 68307197 | 5/1984 | Fed. Rep. of Germany | . |
| 52-34176 | 3/1977 | Japan | 92/13 |
| 57-37108 | 3/1982 | Japan | 92/5 R |
| 2021695A | 12/1979 | United Kingdom | 92/5 R |
| 2051956A | 1/1981 | United Kingdom | 92/13 |

*Primary Examiner*—Robert E. Garrett
*Assistant Examiner*—George Kapsalas
*Attorney, Agent, or Firm*—McGlew and Tuttle

[57] ABSTRACT

The invention relates to a fluid power actuator with a cylinder barrel containing a piston and having end caps through one of which the piston rod extends. The end caps have tie rod openings for the tie rods clamping the end caps together onto the ends of the cylinder barrel. Instead of being used for a tie rod, one of the tie rod openings has a guide rod running through it parallel to the piston rod. The guide rod is joined to the piston rod and moves with it to prevent the piston rod from turning in operation of the actuator. Part of the guide rod is within the opening during the full stroke of the piston.

16 Claims, 3 Drawing Sheets

PISTON ROTATION PREVENTING GUIDE ROD IN CYLINDER TIE ROD OPENING

BACKGROUND OF THE INVENTION

1. Field Of The Invention

The invention relates to a fluid power actuator comprising a cylinder barrel containing a piston and having end caps through one of which the piston rod extends and of which both have tie rod openings to accept tie rods connecting the end caps with each other to clamp them onto ends of the cylinder barrel.

2. Brief Description Of The Prior Art

Cylinder actuators of this type are in widespread use, largely used for applications where they are subjected to substantial forces. In many such applications, as for example in packaging machinery or for table presses whose tool has to be precisely guided, there is the additional requirement of preventing twisting of the piston rod about its axis. One suggestion for effecting this has been to have a piston rod with a square or oval cross section to to have two parallel piston rods. However, such customized designs are complex to manufacture and therefore relatively expensive. Furthermore, they do not comply with ISO standard dimensions so that it is not possible to guarantee compatibility in every case.

In the German Gebrauchsmuster Pat. No. 8,307,197 an actuator without tie rods has been proposed in which twisting of the piston about its axis was to be prevented by the use of a guide rod connected with the piston and with a bearing on the radial outer face of one of the end caps so that the rod only moved in a direction parallel to the axial direction of the piston rod. However, this means for preventing rotation of the piston would not be suitable for combination with an actuator of the initially mentioned type. Even in the case of combination with a conventional actuator without tie rods, the result is a relatively large overall breadth of the actuator arrangement and if the system for preventing piston rotation were to be employed with an actuator of the initially mentioned design the breadth would be substantially increased, since such an actuator is provided with end caps with an inherently larger diameter in order to make it possible for the tie rods to be connected therewith. A further point is that in the case of such a combination of the guide rod at a relatively large distance from the outer face of the cylinder the rod would be in an exposed position so that if there were a shortage of space there would be a danger of the guide rod bending, something that would prevent proper use of the actuator. A combination of the actuator of the initially mentioned construction with the known anti-twist means of the said German patent would therefore have the consequence that there would be an unfavorable change in the dimensions of the actuator and this would be unacceptable in the case of the said special fields of application since in such a case the important aim is to produce an actuator which combines extremely high mechanical load carrying capacity with the greatest possible degree of compactness.

SUMMARY OF THE INVENTION

One object of the present invention is to overcome the above disadvantages of the prior art so far and to devise an actuator of the initially stated type which while being compacted in design has a simple and cheaply produced means for preventing rotation of the piston about its axis.

A further aim of the invention is to devise such a means that furthermore does not increase the breadth of the actuator measured in a direction perpendicular to the direction of its stroke or does not increase such breadth to anything more than a insubstantial extent.

Furthermore the system of the invention is to be capable of use with existing actuators.

In order to achieve these or other aims appearing in the course of the following specification, one of the tie rod openings in the end cap having the piston rod extending therethrough is free of a tie rod, at a point outside the cylinder barrel there is a connection detachably fixed on and extending radially therefrom, and the connection carries a guide rod parallel to the axis of the piston rod, such guide rod being axially fixed in relation to the connection and being at a radial distance from the piston rod which is approximately equal to the said opening and the axis of the piston rod, part of the length of the guide rod extending through the unoccupied opening and being able to slide longitudinally in such opening. This arrangement offers the advantage of a means for preventing piston rotation that is very much cheaper that conventional constructions as for example the use of an oval piston rod or the like. Assembly is extremely simple and there is the advantage in this respect that it is only necessary to remove one of the tie rods from an actuator of the initially stated type and then to insert the guide rod in the unoccupied opening and to mount the connection on the piston rod. There is then not the least increase in the breadth of the actuator and the guide rod will simply occupy the same radial position as the tie rod that has been previously removed. During the stroke of the piston rod both the connection and also the guide rod are moved as well, the latter constantly remaining in the unoccupied tie rod opening and providing a security against twisting of the piston rod about its own axis. It is more especially in the case of the modification of an existing actuator of the sort mentioned with the system of the invention that the simple structure of the anti-twisting means offers advantages, as for example it not being necessary to secure any bearing on the cylinder to accept the guide rod. Accordingly the modification of the cylinder may be much more rapid (more especially where access is less readily possible) in the case of actuators that have already been fitted to equipment. A further advantage is the fact that the overall axial length of the cylinder is not increased by being modified to comply with the invention.

In accordance with a preferred feature of the invention a guide rod bearing is detachably secured to the end cap around the piston rod and this bearing has a through opening coaxial to the unoccupied tie rod opening, for the guide rod. This guide rod opening may have a bushing forming a play-free guide means for the guide rod.

These further developments of the invention ensure a precise guiding of the piston rod so that even the very least twisting of the piston about its axis is out of the question.

The guide rod bearing may be mounted on the end face, turned away from the cylinder barrel, of the end cap around the piston rod, as for example by screw means. This further development ensures that the overall size of the actuator as measured perpendicularly to the direction of piston stroke motion is not greater than in a comparable cylinder without means for preventing piston rotation. The feature of the invention does not create any difficulties, even if there is little space available, as regards mounting an actuator of the invention or modification of an existing actuator which has already been fitted. To provide for additional fixation of the rod bearing on the end face, turned away from the barrel, of the end cap with the piston rod running in it, there is a cylindrical piston rod bushing coaxially surrounding the piston rod so as to extend axially from the said end cap, such bearing having a centering face on its outer periphery that is complementary to the outer form of the piston rod guide bushing and such centering face engaging the outer periphery of the guide bushing.

In accordance with a further feature of the invention the connection possesses a clamping sleeve coaxially surrounding the piston rod for holding the connection on the piston rod, such sleeve having a set screw for clamping it on the piston rod to make possible simple fitting and removal of the connection and, more particularly, to make possible adjustment of the connection along the length of the piston rod so that it may even function as an end stop.

The guide rod may be detachably joined to the connection as for example by means of a spring pin or by means of spring rings so that it is then possible to combine different connections and guide rods with each other. This is more especially an advantage if old types of actuators are to be fitted with the system in accordance with the invention which have been made with different piston rod and end cap combinations. Furthermore, this feature of the invention facilitates assembly both of the connections and also of the guide rod.

As part of a further development of the invention, the guide rod comes to an end at such a position that in the retracted position of the piston rod or of the piston its end is short of the side of the end cap facing the end cap with the piston rod extending through it so that even if the actuator is made with a long stroke and a considerable distance between the two end caps, reliable operation will be assured. If the guide rod is made longer than is specified in this feature of the invention it will be necessary for it to be able to move into a suitable unoccupied tie rod opening in the end cap without the piston rod in it. Since in the case of actuators with large strokes the guide rod has to be suitably adapted to the length thereof vibration may occur during operation such that on retraction of the piston rod it may be that the guide rod misses the second tie rod opening. This difficulty is overcome by further features of the invention to be described herein.

The guide rod may be provided with a stroke limiting stop adjacent to the cylinder barrel. This feature in combination with other features of the invention make it possible for the anti-twist system to be employed to steplessly set the desired stroke length from outside. The stroke limiting stop may be detachably clamped on the guide rod as for example by means of a set screw. This constitutes a development of the invention which makes the system simpler and reduces the costs of production.

Further features and advantages of the invention will be gathered from the following account of only two possible forms thereof as illustrated in the accompanying drawings.

DESCRIPTION OF THE PREFERRED EMBODIMENTS

Figure 1:
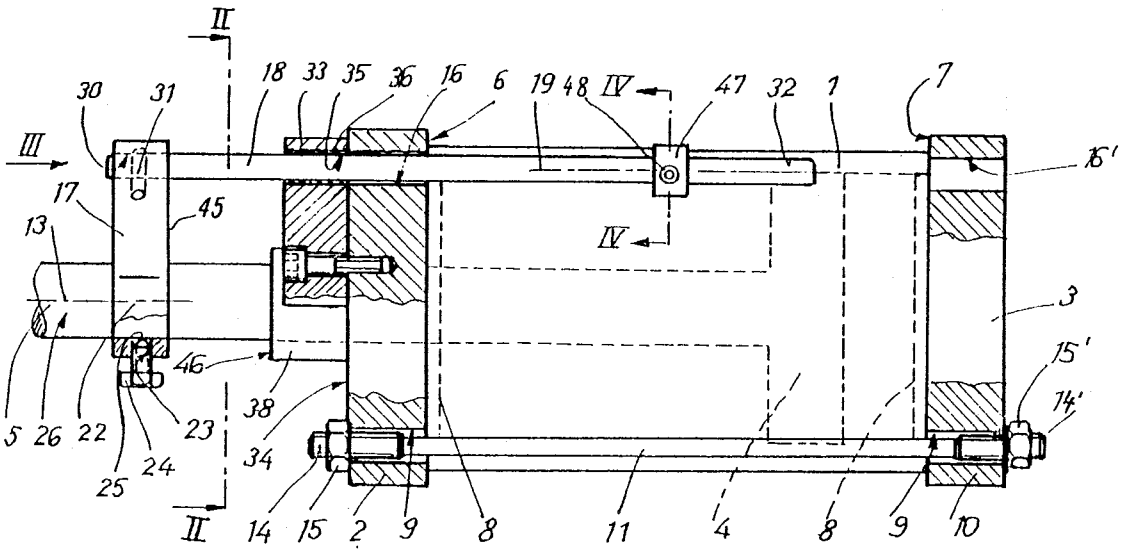
FIG. 1 is a side view of one form of the actuator in accordance with the invention, partly in section.

FIG. 1 shows a first embodiment of the fluid power (i. e. hydraulic or pneumatic) actuator which is made up of a cylinder barrel 1, end caps 2 and 3 mounted on its two ends, a piston 4 running axially in the cylinder barrel, and a piston rod 5 that is joined to the piston 4 and extends through one of the end caps 2. The end cap 2 having the piston rod 5 extending through it will in what follows be termed the piston rod end cap and the second cylinder cap 3 as the plain end cap.

The two cylinder caps 2 and 3 are preferably made rectangular as for example square as seen in the axial direction. On their sides 6 and 7 next to the cylinder barrel 1 they are each formed with a locating pin skirt 8 whose external diameter is the same as the internal diameter of the cylinder barrel 1 and is adapted to fit same. This ensures that the two cylinder caps 2 and 3 are located and correctly positioned in the cylinder barrel 1. The external diameter of the cylinder barrel 1 is preferably somewhat less than the edge length of the caps so that the cylinder barrel is protected against damage if roughly handled.

Figure 2:
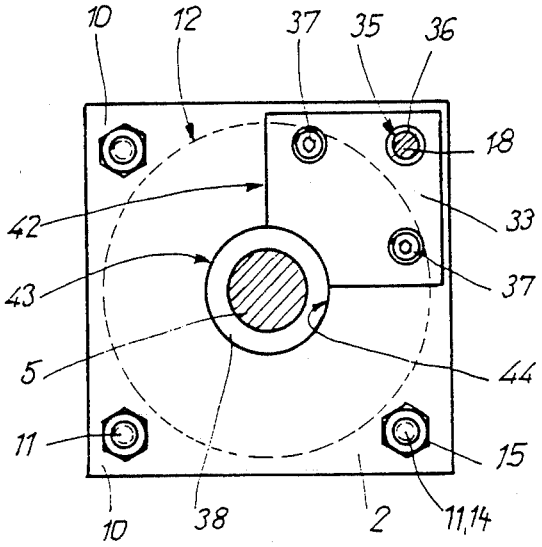
FIG. 2 is a cross section through the actuator of FIG. 1 as taken on the line II—II.

As will be seen from FIGS. 1 and 2 there are tie rod openings 9 in the corners 10 of the cylinder caps 2 and 3 so as to extend in the axial direction of the cylinder and so that each tie rod opening in the piston rod cap 2 axially opposite to an opening in the opposite cap 3. The tie rod openings 9 accept tie rods which connect the caps together and press them axially against the respective ends of the barrel. As will be seen from FIG. 2 the distance between two diagonally opposite tie rod openings 9 is greater than the external diameter of the cylinder barrel 1 so that the tie rods 11 are placed at a radial distance from the outer face 12 of the cylinder barrel 1 and parallel to the longitudinal axis 13 of the actuator or of the piston rod 5. Each of the tie rods 11 is provided with a length of thread 14 and 14' on its two ends so that in the assembled condition such threads extend past the outer sides of the cylinder end caps and have respective nuts 15 and 15' screwed on them in order to draw the two cylinder caps 2 and 3 together and to clamp them on the cylinder barrel 1. The use of the tie rods 11 ensures that the actuator may be operated with a higher than usual internal pressure, since the axial components of the internal pressure are opposed by the additional external force. The working example of the invention to be seen in FIGS. 1 to 3 has four tie rod rod openings 9 for each cylinder cap 2 and 3 so that it is possible to have four tie rods 11 arranged around the outer periphery of the cylinder barrel 1.

In accordance with the invention one tie rod opening 16 of the tie rod openings 9 in the piston rod end cap 2 is not occupied by a tie rod so that necessarily the corresponding and axially opposite tie rod opening 16' in the other cylinder cap 3 is also unoccupied. Accordingly the actuator only has three tie rods 11 (see FIGS. 2 and 3) placed at the corners of isosceles triangle when considered in transverse section. A radially projecting connection 17 or driver is mounted on the piston rod 5 outside the cylinder barrel 1 so that it is not able to twist or slide on the rod 5. At a radial distance equal to the distance between the longitudinal axis 19 of the unoccupied tie rod opening 16 and the axis 13 of the piston rod there is a guide rod 18 on the connection. The guide rod 18 extends parallel to the piston rod and runs in the unoccupied tie rod opening 16 axially in place of a tie rod 11. The length of the guide rod 18 is at least equal to the stroke of the piston 4 so that in every position of the piston rod at least part of the length of the guide rod 18 will run in the unoccupied opening 16.

By way of the connection 17, that is preferably detachably mounted on the piston rod 5 so that it is not able to turn thereon, the guide rod 18 is joined to the piston rod 5. The guiding effect of the guide rod 18 running in the unoccupied opening 16 does not limit the stroke of the piston rod but prevents it from turning about is own axis 13. The guide rod 18 forms a parallel guiding means which serves to keep the piston rod 5 from twisting.

Figure 3:
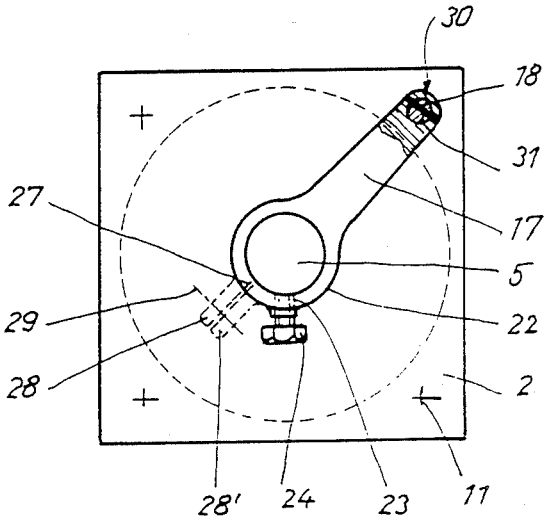
FIG. 3 is an end-on view of the actuator of figure looking in the direction of the arrow III but showing an alternate connection for a guide rod of the actuator.

To locate it on the piston rod 5, the connection 17 is provided with a gripping sleeve 22 as will be more particularly seen from FIG. 3. The clamping or gripping sleeve has such a diameter which as far as possible means that the sleeve may be moved along the piston rod 5 without any play and it has a radial through hole 23 with a screw thread to receive a set screw 24. It is best for the set screw 24 to have a conical point 25 on its free end so as to act on the surface 26 of the piston rod 5 and to accordingly lock the connection 17 on the piston rod so that it may not be turned or slid thereon. It would naturally be possible to employ some different way of securing the connection 17 as for instance making the clamping sleeve 22 with a longitudinal slot 27, as marked in broken lines in FIG. 3 and the free ends of the resulting sleeve halves could be made with two radially projecting opposite clamping arms 28 and 28'. By screwing the two clamping arms 28 and 28' towards each other (at 29) the diameter of the clamping sleeve 22 would be reduced so that there would then be a gripping joint on the piston rod 5.

It will more particularly be seen from FIG. 3 that the attachment of the guide rod 18 to the connection 17 is preferably by plugging the guide rod 18 in a hole 30, coaxial to it, in the connection 17 and pinning it in place there by a tension pin 31 so that it is not able to move in relation to the connection 17. Accordingly there will now be no chance of the guide rod 18 accidentally slipping out of is joint by which it is connected with the connection 17. Other manners of attachment are naturally also possible as for example one in which there are two locking rings opposite the end faces of the guide rod hole to prevent axial sliding in relation to the connection. It is not absolutely essential to have means for preventing twisting of the guide rod 18 in relation to the connection and such means is also not shown. It would also be possible to make the guide rod 18 integral with the connection 17 as shown in FIG. 1 in order to keep down manufacturing costs.

In order to make possible trouble free operation of the actuator in accordance with the invention, the guide rod 18 is such that in the retracted position of the piston rod the rod 18 ends short of the end face 7 facing the barrel 1, of the cap 3. This ensures that when the piston rod 5 is being retracted the guide rod 18 does not have to enter the unoccupied opening 16' of the cylinder cap 3 because it is already in it. This is more especially an advantage in the case of actuators with a long stroke and having a long cylinder barrel 1 and a long guide rod 18. In such a case the amount of vibration occurring during operation might mean that the free end 32 of the guide rod 18 would not be able to slip into the unoccupied tie rod opening 16'. The length of the guide rod 18 obviously has to be such that in the fully extended position of the piston rod 5 at least a part of the guide rod will remain in the unoccupied opening 16 of the cylinder cap 2 around the piston rod.

The actuator in accordance with the invention may be produced with a very small overall size and its dimensions perpendicular to the longitudinal axis are not larger than in the case of an actuator without means for preventing twisting of the piston, as will be more particularly seen from figure 3. Owing to the use of the one tie rod opening as a guide opening for the guide rod the connection 17 takes up a position that is diagonal in relation to the cylinder cap 2 so that there are no components projecting beyond the outline of the cylinder cap 2 and this prevents obstruction. It is a matter of indifference which tie rod opening is used as a guide for the guide rod 18 and a free selection may be made in accordance with the amount of space available in a particular case as to which of the tie rod openings is left unoccupied.

Since more specially in cases in which the fitting of the system in the invention is to be fitted to a conventional actuator with tie rods, the tie rod openings made in the first place are not machined with a high degree of precision, in order to guarantee an exact guiding of the guide rod 18, it is best to employ an additional guide rod bearing 33 which guides the guide rod 18 additional securely and without play. This guide rod bearing 33 is preferably detachably mounted on the side 34 of the piston rod cap 2 facing towards the connection 17. There is a guide rod opening 35 in this bearing 33 preferably in the form of a hole so as to guide the guide rod 18 without play and which is coaxial to the unoccupied tie rod opening 16 (see FIG. 1). To ensure especially accurate guiding of the guide rod 18 the guide rod opening may have a bearing bushing 36 therein as shown in FIG. 1. The attachment of the bearing 33 is for example by the use of two allen key screws 37 (see also FIG. 2) which are countersunk into the bearing 33 and screw the same to the cylinder cap 2. The bearing 33 may for example be in the form of a simple metal bearing plate with a hole machined in it with the required degree of accuracy.

The actuator of the invention to be seen in FIG. 1 possesses a cylindrical piston rod guide bushing 38 which is mounted or formed on the end face 34 to surround the piston rod 5 coaxially so as to provide for an improved guiding action thereon and reduce wear. In this case, see FIG. 2, the guide rod bearing 33 may have part of its outer edge 42 formed with a locating face 44 that mates with the outer form 43 of the guide bushing 38. In the mounted state of the bearing 33 this locating face engages the outer face 43 of the guide bushing 38. On the one hand this embodiment of the invention facilitates assembly of the bearing 33 and on the other hand protects it against unintended shifting, as for example when the actuator is roughly handled.

Since the guide rod bearing 33 is placed in front of the cylinder cap 2 on the connection 17 side thereof, the breadth of the actuator is not changed. Furthermore, the changes in length are insubstantially, more especially in the case of actuators which are in any case manufactured with a piston rod guide bushing 38 of the type described.

Figure 4:
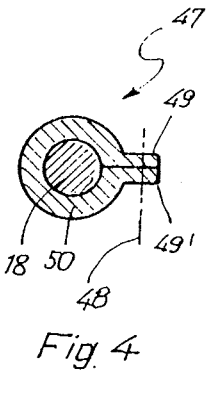
FIG. 4 is a sectional view of the guide rod as taken on the line IV—IV of FIG. 1

Since the connection 17 is detachably joined to the piston rod 5 it may also with advantage be used to limit the size of the stroke, that is to say the amount of travel of the piston rod 5 into the interior of the cylinder barrel 1. Such adjustment is stepless. In this case the end face 45 turned towards the cap 2 of the connection 17 cooperates with the free face 46 of the guide bushing 38 providing an abutting action. If the outward stroke of the piston rod 5 is to be limited, it is for example possible to have a stroke limiting stop 47 on the guide rod 18 between the ends of the cylinder barrel (see also FIG. 4). This stroke limiting stop 47 is in the form of a sleeve and may be adjusted in the longitudinal direction of the guide rod 18. Furthermore it may be clamped on the guide rod 18 in any desired axial position and then released again when desired, this being best effected by the use of a set screw 48. As shown in FIG. 1 there is a radially extending threaded hole in the stroke limiting stop 47 to accept a set screw 48 which may be driven against the surface of the guide rod 18 with a clamping action. The further possibility for the construction of the stroke limiting stop 47 shown in FIG. 4 is designed to be similar to the gripping sleeve 22 marked in broken lines in FIG. 3 and possesses a longitudinally slotted gripping sleeve 50 with two radially projecting clamping arms 49 and 49' which are able to be screwed together. This clamping sleeve 50 is so designed that in the untensioned condition of the clamping arms 49 and 49' it has an internal diameter that is greater than the external diameter of the guide rod 18 and becomes smaller than such diameter on screwing the clamping arms 49 and 49' using the screw 48 so that the clamping sleeve 50 is accordingly firmly clamped onto the guide rod 18. The system for preventing twisting of the piston rod accordingly also provides a simple and low-cost means for limiting the stroke of the actuator.

It will be seen from the above account that the means for preventing piston twist in the actuator of the invention is more particularly suitable for fitting actuators of the initially specified type with a twist preventing system. This modification may be undertaken without any substantial fitting operations and is superior to systems demanding the use of non-standard piston rods.

The invention is naturally not limited to the actuator shown in the drawings and it may be applied to any actuator having tie rods so that the piston is prevented from rotating about its axis. Furthermore the design of the bearing 33 is only to be regarded as one particularly advantageous embodiment so that other forms or manners of attachment are quite readily possible.

Figure 5:
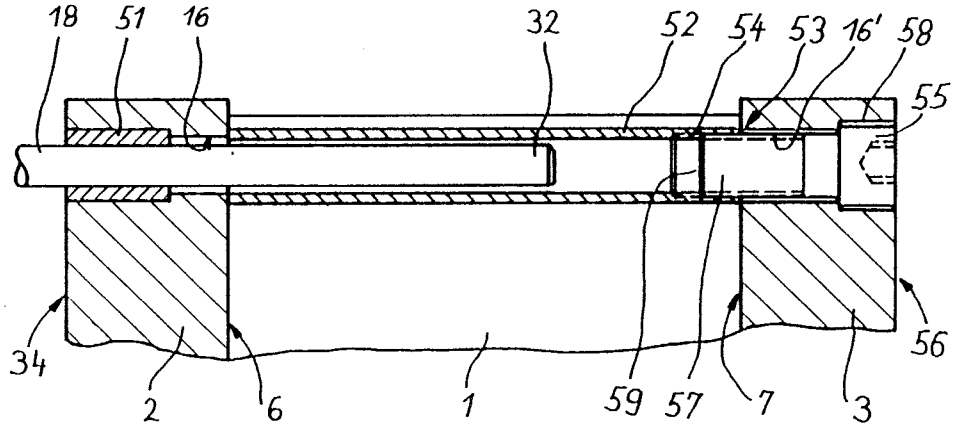
FIG. 5 shows a further working example of the actuator of the invention.

FIG. 5 shows a further advantageous example of the invention in the form of an actuator. It is possible to see parts of the cylinder barrel 1, the end cap 2 around the piston rod and the opposite end cap 3. The guide rod 18 will be seen that coaxially runs through the unoccupied tie rod opening 16 coaxially. Unlike the forms of the invention described so far the opening 16 is stepped and to a certain extent running from the face 34 has a larger diameter in which a guide bushing 51 is inserted. The guide rod 18 runs in the guide bushing 51 with running play so that an exact guiding action is possible. This measure makes it possible to dispense with a separate bearing of the type described so far without any worsening of the guiding action.

In accordance with a further feature of the invention there is a protective tube 52 between the end caps 2 and 3 and so placed that it is coaxial in relation to the two unoccupied tie rod openings 16 and 16'. This tube has an inner diameter that is somewhat greater than the external diameter of the guide rod. The guard tube 52 prevents injuries since the guide rod 18 is completely covered over or surrounded whatever its position. It is thus not possible for the user to hurt himself even if he is careless. The most convenient way of attaching this guard tube 52 on the actuator is by having an internal screw thread 54 running from its end 53 next to the cylinder blank end cap 3 and serving for attachment by being screwed onto a screw 55 extending from the side 56, turned away from the cylinder barrel 1, of the cylinder cap 3 through the unoccupied tie rod opening 16'. The threaded part 57 of the screw 55 extending past the cylinder end cap 3 towards the cap 2 is screwed into the thread 54 so as clamp the guard tube 52 against the side 7 of the end cap 3. Preferably the guard tube 52 so matches the size of the cylinder that its two end faces rest against adjacent sides 6 and 7 of the two cylinder caps 2 and 3. The attachment screw 55 is in the form of an allen key screw with its head countersunk in the a widened part 58 of the unoccupied tie rod opening 16'. The widened part may be provided as a matter of course in all tie rod openings in order to make for firm engagement by the tie rods. However, subsequent courterboring to provide such widenings is also possible, as for example in the case of the tie rod opening 16'. It is naturally possible in the case of a straight and unstepped for of the tie rod opening to use a conventional hex nut screw. However in the case of all the forms of the invention it is necessary for arrangement to be such that in the retracted state of the piston 4 (not shown) the free end 32 of the guide rod 18 ends short of the adjacent side 59 of the attachment screw 55.

In accordance with a further possible form of the invention for fixing the guard tube 52 in place annular grooves are machined in the sides 6 and 7 of the cylinder caps 2 and 3 where the ends of the cylinder tube 52 abut them. Such grooves correspond to the cross section of the guard tube 52 so that the ends of the tube may fit into such grooves. In this case of this way of securing the guard tube 52 it is possible to dispense with an attachment screw 55.

It will be clear that in the embodiment of FIG. 5 it is not possible to use a stroke limiting stop on the guide rod 18 (see part 47, FIG. 1).

In accordance with a further non-illustrated form of the actuator of the invention the guide rod bearing 33 is made with larger dimensions and provided with lugs so that it may be used for mounting the actuator in some suitable position. It is then not necessary to provide separate flanges or the like.

An account will now be given of a particularly advantageous form of joint between the piston rod 5, the connection 17 and the guide rod 18. In the case of thus form of the invention which is not illustrated the connection 17 has a longitudinal slot connecting its sleeve hole and the guide rod hole, such slot passing through the guide rod hole 30 and opening at the end face adjacent the guide rod hole of the connection 17. This longitudinal slot also extends through the hole in the connection sleeve and is continued in the direction opposite to the guide rod hole for a short distance into the connection sleeve. The connection therefore has this slot passing through it for practically its full length. Between the two holes there is a set screw with which the two limbs of the connection as produced by the presence of the slot, may be clamped together. When fitting the connection it is possible to simply slide it onto the piston and guide rods and by then by tightening the set screw the connection is clamped both onto the piston rod and onto the guide rod.

I claim:

1. A fluid power actuator comprising a cylinder barrel, a piston able to move axially within said barrel, a piston rod attached to said piston, a first and a second end cap on opposite ends of said barrel, said piston rod extending through said second end cap, said end caps having openings for tie rods therein, a plurality of tie rods extending axially along said barrel and through said openings in said caps, one such tie rod opening in said second cap being free of a tie rod, an arm-like connection detachably mounted on said piston rod outside said barrel, a guide rod which is parallel to the piston rod and is attached to said connection at a point thereon at substantially the same distance from said piston rod as the distance of said tie rod-free opening, such guide rod extending through said tie rod-free opening at every position of said piston along a stroke thereof and running in said opening to make guiding contact with an inner wall thereof.

2. The actuator as claimed in claim 1 further comprising a guide rod bearing mounted on said second cap and having a hole therein for the guide rod, such hole being positioned coaxially with said tie rod-free opening.

3. The actuator as claimed in claim 2 wherein the said guide rod opening forms a play-free guide for said guide rod.

4. The actuator as claimed in claim 2 wherein the guide rod opening has a bearing bushing fitted therein in which the guide rod runs free of play.

5. The actuator as claimed in claim 2 wherein said guide rod bearing is mounted on a side of said second cap facing away from said barrel.

6. The actuator as claimed in claim 2 comprising a cylindrical piston rod guide bushing coaxially surrounding the piston rod and mounted on the face of the second cap facing away from the barrel so as to extend axially from such face, said guide rod bearing having a locating face on its outer face, such locating face matching the outer form of the piston rod guide bushing and being in engagement with the outer face of the guide bushing.

7. The actuator as claimed in claim 1 wherein the connection is formed with a gripping sleeve coaxially surrounding the piston rod and held thereon by a set screw engaging the piston rod.

8. The actuator as claimed in claim 1 wherein the length of said guide rod is such that in a retracted position of said piston rod into said barrel the guide rod ends short of the side of the first end cap facing said barrel.

9. The actuator as claimed in claim 1 comprising a stroke limiting stop mounted on said guide rod at a point radially near the barrel.

10. The actuator as claimed in claim 9 wherein said stroke limiting stop is an adjustable stop which is releasably clamped onto said guide rod.

11. The actuator as claimed in claim 1 having a guard tube placed between the two end caps and placed coaxially in relation to the opening free of a tie rod, said tube surrounding the guide rod with a radial play coaxially.

12. The actuator as claimed in claim 11 wherein end faces of the guard tube rest against sides of the end caps.

13. The actuator as claimed in claim 11 comprising a set screw extending through said first cap and screwed into a thread in said guard tube.

14. An actuator as claimed in claim 1 including a tension pin connected between said guide rod and said connection for detachably connecting said guide rod to said connection.

15. An actuator as claimed in claim 1, wherein said connection and said guide rod are made integrally.

16. A fluid power actuator comprising:

a cylinder; a piston adapted to move axially within said cylinder; a piston rod attached to said piston; a first and a second end cap positioned on opposite ends of said cylinders, said piston rod extending through said second end cap, said end caps each having openings for tie rods therein; a plurality of tie rods extending axially along said cylinder and through said openings in said caps, one such tie rod opening in said second cap being free of a tie rod; and an arm-like connection detachably mounted on said piston rod outside said barrel; a guide rod bearing block detachably mounted to said second end cap, said guide rod bearing block having a guide rod opening positioned coxially with said rod-free opening; and, a guide rod which is parallel to said piston rod and is attached to said arm-like connection, said guide rod extending through said tie rod-free opening and said guide rod bearing block opening at every position of said piston along a piston stroke so as to make guiding contact with an inner wall of each of said guide rod bearing block opening an said tie rod-free opening.

* * * * *